United States Patent [19]

Theurer

[11] 4,396,323

[45] * Aug. 2, 1983

[54] MOBILE RAIL CONTOURING MACHINE

[75] Inventor: Josef Theurer, Vienna, Austria

[73] Assignee: Franz Plasser Bahnbaumaschinen-Industrie-Gesellschaft m.b.H., Vienna, Austria

[ * ] Notice: The portion of the term of this patent subsequent to Dec. 28, 1999, has been disclaimed.

[21] Appl. No.: 141,891

[22] Filed: Apr. 21, 1980

[30] Foreign Application Priority Data

Aug. 14, 1979 [AT] Austria ..... 5536/79

[51] Int. Cl.[3] ..... B23D 1/10; B23D 7/06; B24B 23/00

[52] U.S. Cl. ..... 409/296; 51/178; 409/298; 409/339

[58] Field of Search ..... 409/178, 180, 296, 298, 409/337, 338, 339, 300; 51/178; 144/133 B; 29/402.19

[56] References Cited

U.S. PATENT DOCUMENTS

| | | | |
|---|---|---|---|
| 1,025,754 | 5/1912 | Little | 409/319 X |
| 1,032,721 | 7/1912 | Woods et al. | 29/402.19 X |
| 1,216,097 | 2/1917 | Eunson | 409/180 |
| 1,988,138 | 1/1935 | Peck | 51/178 |
| 2,741,883 | 4/1956 | Scheuchzer et al. | 51/178 |
| 3,597,958 | 8/1971 | Gross | 409/300 X |
| 3,888,052 | 6/1975 | Panetti | 51/178 X |
| 4,050,196 | 9/1977 | Theurer | 51/178 |
| 4,074,468 | 2/1978 | Panetti | 51/178 |
| 4,115,857 | 9/1978 | Panetti | 51/178 X |

FOREIGN PATENT DOCUMENTS

| | | | |
|---|---|---|---|
| 1263568 | 5/1961 | France | 51/178 |
| 1083378 | 9/1967 | United Kingdom | 51/178 |

*Primary Examiner*—Z. R. Bilinsky
*Attorney, Agent, or Firm*—Kurt Kelman

[57] ABSTRACT

A mobile rail contouring machine is arranged for continuously milling such running surface irregularities as ripples, corrugations and overflow metal from rail heads during the continuous movement of the machine along a railroad track. The machine comprises a frame, a rail contouring tool mounting linked to the frame, guide rollers for vertically and laterally guiding the mounting without play along the sides and the running surface of the rail head of each rail and for pressing the mounting thereagainst, and a rail contouring tool head including a tool holder arranged on the mounting. A rail contouring tool is mounted in the tool holder and the tool head is displaceable with respect to the mounting in directions extending parallel and perpendicularly to the track.

30 Claims, 7 Drawing Figures

Fig. 4 (F-F)
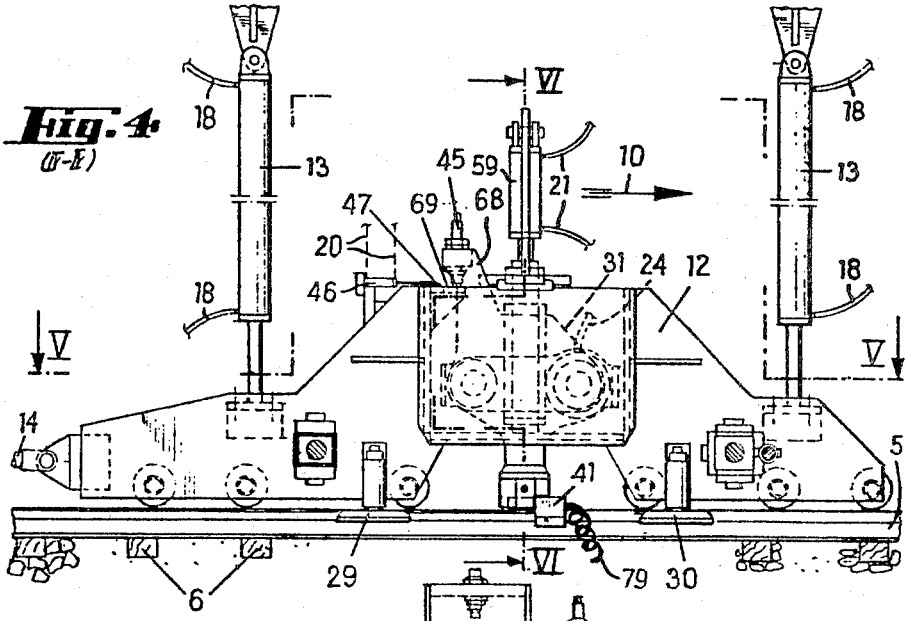
Fig. 5 (F-F)
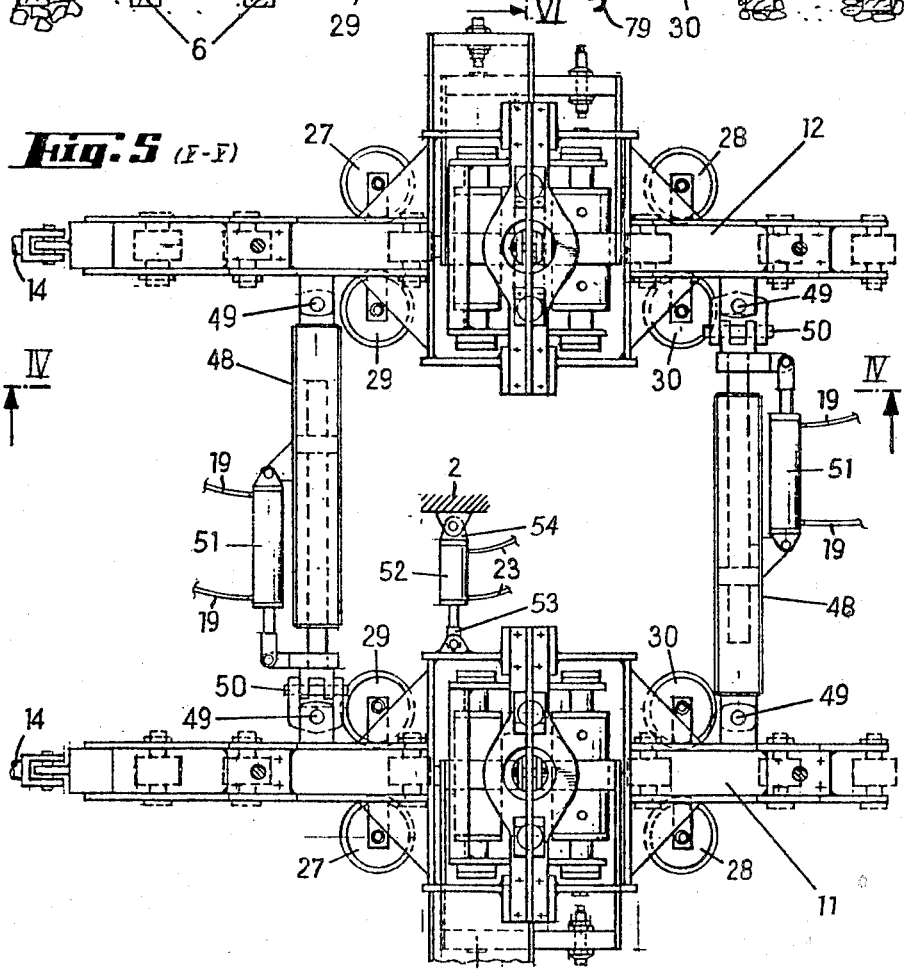

Fig. 6
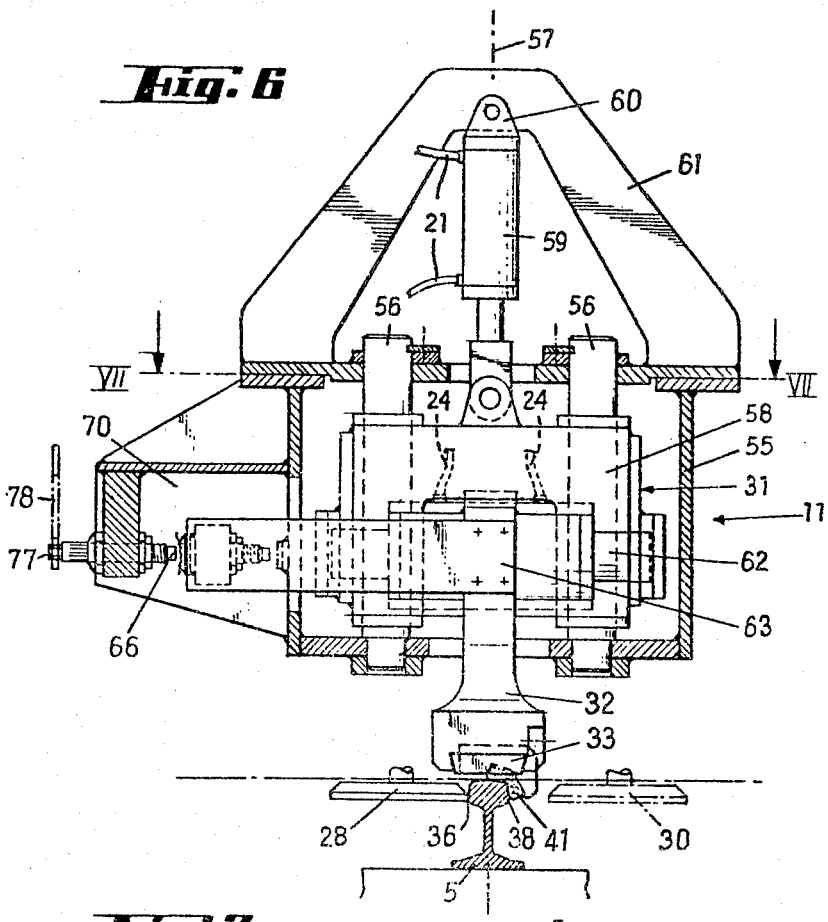
Fig. 7 (VII-VII)
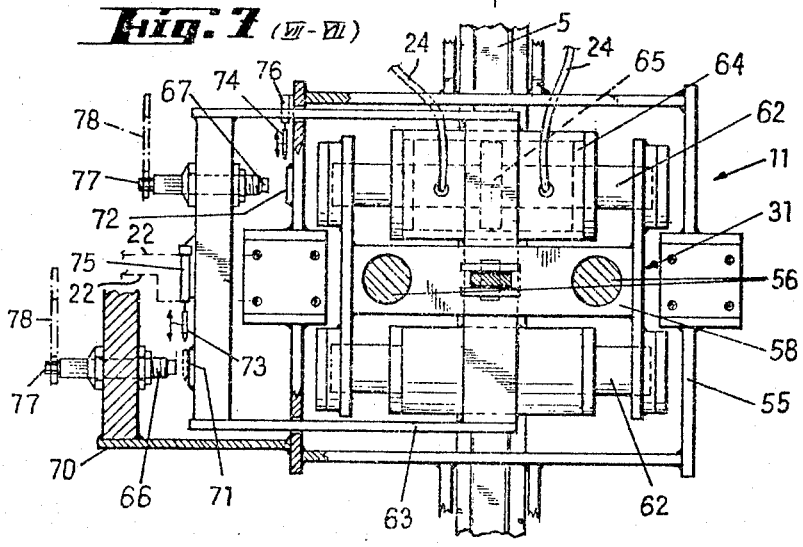

MOBILE RAIL CONTOURING MACHINE

The present invention relates to a mobile rail contouring machine mounted on a railroad track for continuous movement in an operating direction, the track including two rails each having a rail head defining a gage side, a field side and a running surface, and the machine being arranged for continuously removing such running surface irregularities as ripples, corrugations and overflow metal during the continuous movement.

Known machines of this type comprise a frame, a rail contouring tool mounting linked to the frame, drive means for vertically adjusting the mounting relative to the running surface of the rail head of a respective rail and for pressing the mounting thereagainst, the mounting being guided vertically and laterally along the sides and the running surface of the rail head, a rail contouring tool head including a tool holder arranged on the mounting and a rail contouring tool mounted on the tool holder. The rail contouring tool may be a rotary grinding disk or a whetstone and, where it was desired to remove the irregularities to a greater depth, a planing tool including a cutting blade.

U.S. Pat. No. 2,779,141, dated Jan. 29, 1957, discloses a mobile rail grinder wherein two mountings are arranged between the undercarriages of a mobile machine and are guided along the track rails by flanged sheels. Each mounting carries three independent grinding devices independently vertically adjustable with respect to the mounting, each grinding device having a vertical rotary shaft and a grinding disc at the lower end of the shaft. The pressure of each grinding disc against the rail is controlled by a complex and multi-part control and the amount of metal ground off during each pass of the machine is so small that numerous passes are required to obtain a noticeable grinding result, requiring long periods of time closing the track to passenger or freight traffic. Therefore, it has been proposed to couple a number of such rail grinders together to form a train so as to reduce the number of grinding passes. Such rail grinder trains are expensive, require considerable operating personnel and substantial maintenance and organizational efforts for planning the work and controlling the traffic interrupted thereby. The construction and maintenance of the proper controls for guiding and operating the mountings and the grinding discs are also extensive.

U.S. Pat. No. 4,050,196, dated Sept. 27, 1977, improves on this type of mobile rail grinder by associating shaping tools with the rotary grinding discs for profiling the grinding surfaces of the discs. This machine comprises a mounting linked to the frame, vertically adjustable in relation thereto and guided along the two track rails by flanged wheels, a tool head being vertically and laterally displaceably arranged in the mounting for centering the grinding disc carried by the tool head with respect to the associated rail. This improves the accuracy of the grinding operation and the adjustment of the grinding discs. However, since the vertically adjustable tool heads must be adapted closely to the profile of the rail head, due to the presence of the shaping tools, there is little room for adapting to different profiles and irregularities. Furthermore, the adjustable mountings and tool heads are relatively complicated.

German Pat. No. 905,984, published Mar. 8, 1954, discloses a vise clamped to a rail at a rail joint and carrying a mechanism including a tool head mounting a tool for milling the welded joint. The tool head is cranked back and forth along the running surface of the rail head to plane the joint. This device is only useful locally at respective rail joints and cannot be used for the continuous contouring of a rail. It is also complex in construction and use.

U.S. Pat. No. 4,249,346, filed Feb. 21, 1978, and granted Feb. 10, 1981, discloses a mobile rail grinding machine wherein two groups of whetstones are mounted on two carriages guided along the rails by flanged wheels. A common mechanism reciprocates the two carriages to superimpose working motion to the whetstones in addition to the continuous motion exerted by the advancement of the machine. This considerably increased the efficiency compared to prior machines working with whetstones and grinding discs but it still did not produce desirable depths of metal removal, particularly with high accuracy, which is important for attaining operational economy.

U.S. Pat. No. 4,295,764, filed Dec. 11, 1978and granted Oct. 20, 1981, discloses a mobile rail contouring machine with a plurality of mountings vertically adjustably connected to the machine frame and vertically and laterally guided along the rail, each mounting carrying a number of cutting blades or whetstones. The mounting with the cutting blades affixed thereto is vertically adjustable relative to the flanged wheels supporting it on the rail so as to position the cutting blades in relation to the running surface of the rail head for milling it. The mountings associated with each rail are linked together by a hydraulic cylinder-piston unit for spreading the mountings and blocking them in position. This arrangement made it possible for the first time to obtain the continuous removal of irregularities from the running surface of the rail head with cutting or planing tools at high efficiency but it was not always possible to achieve accurate contouring to the desired profile. In addition, centering of the contouring tools and setting them properly in relation to the surface to be milled was often difficult.

It is the primary object of this invention to provide a mobile rail contouring machine for continuously removing such running surface irregularities as ripples, corrugations and overflow metal during the continuous movement of the machine along a railroad track, which efficiently mills the irregularities while enabling an accurate setting of the rail contouring tools.

The above and other objects are accomplished according to the invention with a mobile rail contouring machine comprising a frame, a rail contouring tool mounting linked to the frame and guide roller means for vertically and laterally guiding the mounting without play along the gage and field sides and the running surface of the rail head of one of the rails. Drive means vertically adjusts the mounting relative to the running surface of the rail head of the one rail and presses the mounting thereagainst. A rail contouring tool head including a tool holder is arranged on the mounting and a rail contouring tool is mounted in the tool holder. The present invention provides means for displacing the tool head with respect to the mounting in directions extending substantially parallel to the track and substantially perpendicularly thereto.

This displaceability of the tool head enables the tool to be adjusted and set with considerably enhanced accuracy and the mounting provides, in effect, a moving vise that holds the rail head in a rigid position against the hydraulically applied force of the cutting operation. In this manner, accurate contouring of the rail head is obtained with respect to any rail head profile.

The above and other objects, advantages and features of this invention will become more apparent from the following detailed description of a now preferred embodiment thereof, taken in conjunction with the drawing wherein FIG. 1 shows a somewhat schematic side elevational view of the mobile rail contouring machine;

FIG. 4 is a view similar to that of FIG. 2, and in partial section along line IV—IV of FIG. 5;

FIG. 5 is a plan view of an assembly of two linked mountings, along line V—V of FIG. 4;

FIG. 6 shows a sectional view of the mounting along line VI—VI of FIG. 4; and FIG. 7 is another sectional view of the mounting along line VII—VII of FIG. 6.

Figures 1, 2, 3:
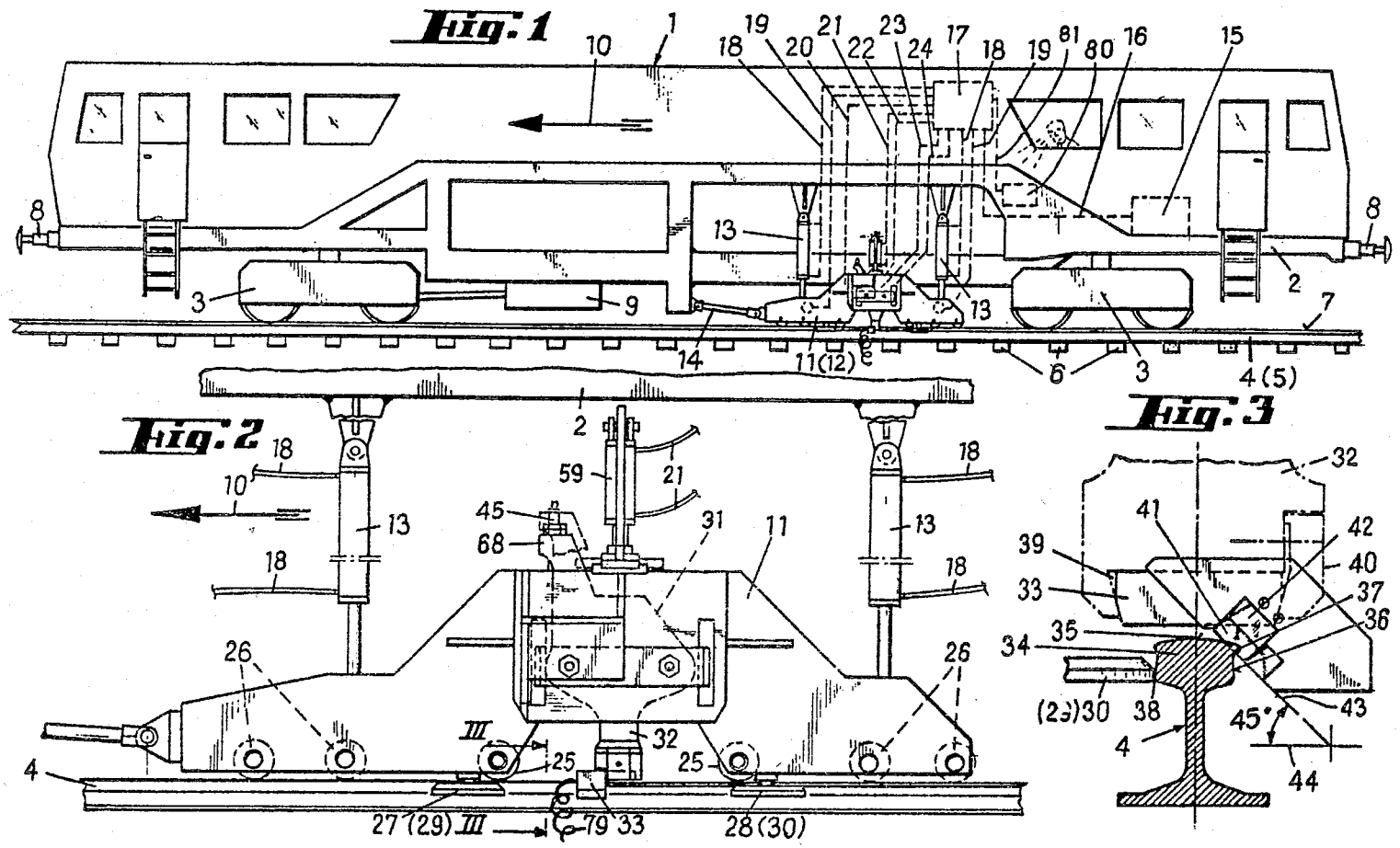
FIG. 2 is an enlarged side elevational view of the rail contouring tool mounting and the tool head arranged thereon.
FIG. 3 is a transverse section along line III—III of FIG. 2, showing the tool setting in an enlarged view.

referring now to the drawing and first to FIG. 1, there is shown mobile rail contouring machine 1 mounted on railroad track 7 for continuous movement in an operating direction indicated by arrow 10. The track includes ties 6 to which are fastened two rails 4 and 5 each having a rail head defining gage side 38, field side 36 and running surface 35 (see FIG. 3). The machine is arranged for continuously removing such running surface irregularities as ripples, corrugations and overflow metal 37 during the continuous movement in the operating direction.

Rail contouring machine 1 comprises frame 2, rail contouring mounting 11, 12 linked to the frame, and guide roller means 25 to 30 for vertically and laterally guiding the mounting without play along the sides and the running surface of the rail head of a respective rail. Machine frame 2 has couplings 8, 8 at respective ends thereof to enable the same to be incorporated into a train for movement between working sites over long distances. The machine also has its own drive 9 which powers the two axles of at least one of the undercarriages 3,3 which support frame 2 for mobility on the track.

Drive means 13 vertically adjusts mounting 11, 12 relative to the running surface of the rail head of the respective rail and presses the mounting thereagainst. Rail contouring tool head 31 including tool holder 32 is arranged on the mounting and rail contouring tool 33 is mounted in the tool holder. The illustrated and preferred tool is a planing tool consisting of a cutting blade for continuously milling the running surface irregularities, and more particularly the overflow metal, off the rail head.

In the illustrated embodiment, all operating drives are hydraulically operated, including drive means 13 which consists of two substantially vertically extending cylinder-piston drives having their respective ends linked to machine frame 2 and mounting 11, 12. Connecting rod 14 extending in the direction of track 7 links one end of each mounting to machine frame 2. Central power plant 15 is mounted on the machine frame, the power plant including, for example, a fluid pressure generator and an electric generator coupled to a Diesel motor. Furthermore, operating connection 16 connects the central power plant to control 17 for remote control of the various machine operations, conduits 18, 18 connecting the cylinder chambers of drives 13 to the control and further conduits 19–24 connecting the control to other mechanisms to be described hereinafter.

While FIG. 2 shows mounting 11 which is visible in the side elevation of FIG. 1 and is associated with rail 4, FIG. 4 shows mounting 12 associated with rail 5. As illustrated, rail contouring tool head 31 is displaceable with respect to the mounting in directions extending substantially parallel and perpendicularly to track 7 in a manner described hereinafter with particular reference to FIGS. 6 and 7.

The guide roller means illustrated herein comprises a plurality of guide rollers 25, 26 for vertically guiding the mounting along the running surface of the rail head and two pairs of guide rollers 27, 29 and 28, 30 for laterally guiding the mounting along a selected side 36, 38 of the rail head. Tool head 31 is mounted substantially centrally between the pairs of guide rollers. As shown, the guide rollers of the two pairs have axes extending substantially vertically to the track. This arrangement provides a vise that holds the rail head in a rigid position in the vertical and lateral directions while the rail head is being continuously milled. The mounting is laterally guided along one or the other side of the rail head, the side which is not worn being selected for guidance. In the preferred embodiment illustrated herein, tool head 31 is mounted intermediate the two guide rollers 25, 25 for vertically guiding the mounting and two additional guide rollers 27, 28 and/or 29, 30 for laterally guiding the mounting along one of the rail head sides. This central mounting of the tool head between the adjacent vertical and lateral guide rollers has the advantage of providing a symmetrical distribution of the work forces and proper positioning of the rail contouring tool and the guide rollers in either operating direction of the machine. The illustrated guide roller means comprises two sets of three guide rollers 25, 26, 26 for vertically guiding the mounting along the running surface of the rail head, each one of the two sets including a respective guide roller 25 adjacent tool head 31 and the tool head being mounted substantially centrally between guide rollers 25, and two pairs of additional guide rollers 27, 29 and 28, 30 for laterally guiding the mounting along a selected side 36, 38 of the rail head, the two pairs of additional guide rollers being immediately adjacent guide rollers 25, 25. Guide roller 25, 26 are preferably detachably arranged on the mounting for selective use thereof. This arrangement is used particularly for removal of ripples or corrugations which requires an adjustment of the mounting support on the rail to adapt it to the wavelength of the corrugations. Some of the guide rollers 25, 26 may accordingly be detached. For instance, if only guide rollers 25 are used, as shown in full lines in FIG. 2 (while the location of the selectively used guide rollers 26 is shown in broken lines), overflow metal 37 requiring milling to a relatively shallow depth can be removed. For this purpose, the distance between the guide rollers is chosen as small as possible.

FIG. 3 graphically illustrates the operation of the machine on rail head 34 of rail 4 of track 7 in the transition region between running surface 35 and field side 36 of the rail head to remove overflow metal 37 produced by the train traffic rolling over the track over a period of time. In this operation, mounting 11 is supported on the rail only by guide rollers 25, 25 while guide rollers 26 have been detached and the mounting is guided laterally without play by guide rollers 29, 30 engaging gage side 38 of the rail head. The arrangement provided for this lateral guidance of mounting 11 will be described in detail hereinafter.

Tool holder 32 has been shown in FIG. 3 in chaindotted lines and defines substantially dove-tailed recess 39 receiving rail contouring tool 33 rigidly held in the recess of clamping plate 40. Cutting blade 41 of tool 33 is detachably mounted on the tool by means of clamping shoes 42. It is made of a very hard material, such as carbide steel. For removal of overflow metal 37, cutting edge 43 of the cutting blade is so arranged on tool 33 that it encloses an angle of about 45° with plane 44 defined by the track of parallel thereto.

FIG. 4 shows like mounting 12 associated with rail 5, the mounting, tool head and rail contouring tool being identical with that described hereinabove in connection with FIGS. 2 and 3, mountings 11 and 12 being arranged symmetrically in relation to a central plane extending vertically between rails 4 and 5. Arrow 10 in FIG. 4 indicates an operating direction opposite to that indicated in FIG. 2 for restoring the entire running surface to the original and desired contour by removing the overflow metal in the transition region between running surface 35 and gage side 38 of rail head 34. In this figure, guide rollers 26 (shown in full lines) are attached to the mounting so that it is supported on rail 5 by two sets of three rollers so as to enable the machine to remove corrugations or ripples of various wavelengths, in contrast to FIG. 2 which shows the machine operational only for the removal of overflow metal.

FIG. 5 illustrates the preferred embodiment wherein a single mounting 11, 12 is linked to machine frame 2 in association with each rail 4, 5, a single tool head 31 is arranged on the mounting and a single planning tool 33 having cutting blade 41 is mounted on tool holder 32 of the tool head. The mountings are in substantial alignment in a direction transverse to the rails, and transversely extending spacing members 48, 48 continuously adjustable to the gage of the track link the mountings to each other. This arrangement produces high operating forces for a given machine weight and accordingly attains high metal removal efficiency. The adjustable spacing members enable the mountings to adapt to all changes in the track gage despite the high working forces applied thereto and to hold the mountings rigidly on their associated rails during the milling operation.

As shown, drive means constituted by hydraulic drives 51 connected to spacing members 48 continuously press the guide rollers for laterally guiding the mounting against the sides of the rail heads. The illustrated spacing members are comprised of two substantially parallel telescoping cylinder-piston devices having their respective ends linked to mountings 11 and 12. Pivot 49 extending vertically to track 7 links each end of the cylinder-piston devices to the mountings, and further pivot 50 extend parallel to the track at diagonally opposite ends whereby a universal joint 49, 50 is formed between the diagonally opposite ends of the cylinder-piston devices and the mountings. With this arrangement, the mountings are simultaneously pressed against both field sides or both gage sides of rail heads 34 of rails 4 and 5 to work alternatively and simultaneously on the field and gage sides of both rail heads. The illustrated linkage of the two spacing members to the mountings enables the mountings to remain rigidly positioned in a vertical plane defined by the web of the rails with which they are associated, regardless of the course of the track, particularly its superelevation, and also independent of the angle each rail encloses with the track plane, i.e. whether the rails are perpendicular to this plane or, as is often preferred in modern railroad tracks, the rails are inwardly inclined towards each other. Due to the universal joints linking the two spacing members to the opposite mountings at diagonally opposite points, the mountings can move relative to each other on superelevated track.

Hydraulic drives 51 have one end linked to the cylinder of spacing members 48 while the other end thereof is linked to the piston rod telescopingly mounting a piston in the cylinder. Conduits 19 lead from control 17 to the chambers of the cylinders of drives 51 to enable the spacing members to be adjusted continuously by remote control to the gage of the track. Drives 51 enable the selective engagement of lateral guide rollers 29, 30 of mountings 11 and 12 with gage sides 38 of the rail heads of rails 4 and 5 or of lateral guide rollers 27, 28 of the two mountings with field sides 36 of the two rail heads. Therefore, both mountings exactly and without play follow the course of each rail at any track gage and thus provide a rigid vise for the milling tools. The operative cutting blade is always arranged for milling along the side of the rail head opposite to the side engaged by the lateral guide rollers (see FIG. 3). Therefore, the lateral guide rollers form a counter-bearing receiving the milling forces exerted by cutting blade 41 and extending laterally towards this counter-bearing.

As illustrated in FIG. 5, the assembly of linked mountings further comprises a means for centering the linked mountings with respect to track rails 4, 5 to facilitate the setting and removal of mountings 11 and 12 at the beginning and end of the milling operation, respectively. The illustrated centering means includes substantially horizontally extending drive 52 generating a horizontal force component and having one end 53 linked to one of the mountings, for instance mounting 11, and another end 54 linked to machine frame 2. The illustrated drive is also a hydraulic drive connected to control 17 by conduits 23 for remote control of the centering operation. Before the two linked mountings are lowered from their rest position above the track into their operating position on the track, they are centered with respect to rails 4 and 5 by operating drive 52 and, if required, drives 51, whereupon the centered mountings are lower by operation of hydraulic drivers 13 until they come to sit on the rails.

The means for displacing tool head 31 with respect to the mounting in directions extending substantially parallel and perpendicularly to the track is shown in FIGS. 6 and 7 in connection with mounting 11, the arrangement being identical on mounting 12. The preferred and illustrated displacing means comprises guide columns 56 and 62 mounting tool head 31 on mounting 11 for movement substantially parallel and perpendicularly to the track, the guide columns being shown as cylindrical and the tool head being slidable therealong. The guide columns comprise a first pair of guide columns 56 extending in one direction and affixed to mounting 11, and a second pair of guide columns 62 extending in the other direction and affixed to tool head 31. In the preferred embodiment illustrated herein, guide columns 62 of the second pair extend in a direction substantially parallel to track 7. This structural arrangement produces a very accurate guidance of the tool head relative to the mounting in both directions with relatively simple structural elements while assuring rigid positioning of the tool head relative to the mounting in all positions, including the operating position. This rigid fixation of the tool head on the mounting assures a high milling accuracy to produce a uniform surface quality of the rail head contour over long track sections.

As shown, the first pair of guide columns 56, 56 is arranged between the second pair of guide columns 62, 62. This enables the entire tool head displacement system to be arranged in a very small space even if massive guide columns are used, thus making it possible to space adjacent guide rollers 25, 25 for the mounting relatively closely together. This contributes substantially to the desired rigidity of the entire arrangement.

Mounting 11 include substantially centrally arranged housing 55 displaceably receiving tool head 31 which is comprised of first frame part 58 and second frame part 63. Vertical guide columns 56 are rigidly connected to housing 55 and extend therethrough symmetrically with respect to vertical center plane 57 of the housing defined by the web of rail 5. First tool head part 58 is vertically slidably mounted on the vertical guide columns. Mounting 11 is shown to comprise yoke 61 and the means for displacing tool head 31 in a direction substantially perpendicular to track 7 comprises drive 59 connecting the tool head to the yoke of the mounting substantially at the center of the yoke. The illustrated displacement drive also is a hydraulic drive connected to control 17 by conduits 21 for remote control of the tool head displacement, one end of drive 59 being linked to tool head part 58 and the other drive end being linked to yoke 61. This arrangement assures a central application of the vertical displacement force to the tool head and the symmetrical positioning of the guide columns with respect thereto prevents any flexing moment to be exerted on the tool head.

As shown in FIG. 7, first tool head part 58 is substantially H-shaped and substantially horizontally extending guide columns 62, 62 are rigidly affixed to this tool head part and extend perpendicularly to plane 57. Guide columns 62 are arranged symmetrically with respect to a plane defined by intermediately positioned guide columns 56, 56. Second tool head part 63 is horizontally slidably mounted on these guide columns.

In the preferred embodiment illustrated herein, the means for displacing tool head 31 in a direction substantially parallel to track 7 a hydraulic cylinder-piston drive, cylinder 64 of the drive being glidably mounted on one guide column 62 and drive piston 65 being a double-acting piston affixed to this guide column within cylinder 64. Conduits 24 connect the chambers of cylinder 64 to control 17 for remote control of the tool head displacement in a horizontal direction. This arrangement dispenses with a special and separate drive, using one of the guide columns for this purpose and thus simplifying the construction and saving space.

Tool holder 32 of tool head 31 is rigidly affixed to, or integral with, second tool head part 63 so that rail contouring tool 33, 41 is displaceable relative to mounting 11 and its housing 55 along columns 56 in a vertical direction and along columns 62 in a horizontal direction.

According to a preferred feature of the present invention, adjustable stop means are provided for limiting the displacement of tool head 31 in the vertical and horizontal directions whereby tool 33, 41 may be set for predetermined removal depths. The vertical setting is provided by an adjustable stop means comprising adjustable stop element 45, abutment element 69 for engagement with the stop element, the stop means elements being respectively mounted on mounting 11 and on tool head 31, and intermediate stop 47 mounted for insertion between the adjustable stop element and the abutment element. The intermediate stop has a thickness corresponding substantially to the depth of removal to be obtained during one pass of machine 1 during continuous movement thereof in the operating direction indicated by arrow 10. The horizontal setting is provided by first adjustable stop element 66 mounted on tool head 31 and abutment element 71 affixed to mounting 11 for engagement with the first adjustable stop element, and another adjustable stop element 67 mounted on mounting 11 and another abutment element 72 affixed to tool head for engagement with the other adjustable stop element. Like intermediate stops 73 and 74 are respectively mounted for insertion between adjustable stop element 66 and abutment element 71, and adjustable stop element 67 and abutment element 72.

With such adjustable stop means, the tool heads are set at the beginning of the operation to obtain the desired depth of milling. Each time the machine is stopped, the tool heads are lifted to remove the cutting blade edges from the running surface of the rail heads and thus to avoid damage to the cutting edges. When advancement of the machine is resumed, the set stop means assure the proper tool setting when the tool head is lowered again, without requiring readjustments. The setting is so chosen that the tools will mill the rail head to the desired contour. It depends on the dimensions and the profile of the rail head as well as the average and maximal wear thereof, and a proper setting provides additional assurance against possible damage to the rail and/or to the tools. The provision of the two adjustable stop means for limiting the lateral movement of the tool head provides high accuracy for the pre-set operating position since only the mounting and the tool head are used for support of the stop means elements. The arrangement of the intermediate stop insertable between the stop means elements is of particular advantage when the machine is used for milling greatly and largely unevenly worn rail head surfaces, such as considerable ripples or corrugations which require substantial metal removal to obtain the desired rail head contour. In such cases, after the tool head has been set for the desired rail head profile, the removal of the surface irregularities is effected stepwise in two or more successive passes of the machine, the thickness of the intermediate stop determining the removal depth during each pass. During the last pass, the machine is operated without the insertion of the intermediate stop so that the tool is set for the desired profile. The intermediate stop makes it unnecessary to readjust the tool setting between successive passes of the machine.

The operation of the adjustable stop means illustrated herein by way of example will be described hereinbelow, referring first to FIGS. 2 and 4 showing the stop means limiting the vertical displacement of the tool head. As illustrated, first frame part 58 of the tool head 31 has upwardly projecting portion 68 on which adjustable stop element 45 is mounted. Fixed abutment element 69 is mounted on mounting 11 for engagement with the adjustable stop element to delimit the vertical downward stroke of tool head 31 relative to mounting 11, thus setting cutting blade 41 to the desired maximal penetration into the surface of the rail head for obtaining the desired contour thereof. This is to zero setting. When the irregularities are so severe that milling them requires more than one pass of machine 1, the milling depth may be stepwise adjusted by insertion of intermediate stop 47 between adjustable stop element 45 and abutment element 69 for each pass. The intermediate stop is inserted by operation of hydraulic device 46, to which the intermediate stop is affixed, and which is connected by conduits 20 to control 17 for remote control of the insertion. In this way, it is not necessary to readjust stop element 45 after each pass.

Similarly, stop means 66, 71, 73 and 67, 72, 74 serve to delimit the lateral displacement of tool head 31 for the stepwise adjustment of the milling depth in a horizontal direction. As described in connection with the vertical stop means, intermediate stops 73 and 74 are affixed to hydraulic devices 75 and 76, respectively, which are connected to control 17 by conduits 22 for remote control of the insertion of these stops between elements 66 and 73, on the one hand, and 67 and 74, on the other hand. As shown in FIGS. 6 and 7, stop elements 66 and 67 may be adjusted rapidly by wrench 78 engaging polygonal end 77 of the stop elements.

As shown in FIG. 1, the machine frame preferably is a relatively heavy frame having two undercarriages 3, 3 supporting the frame on track 7 for continuous movement thereof, the illustrated undercarriages being swivel trucks and the entire machine taking the form of a regular track surfacing machine. Mounting 11, 12 with tool head 31 and rail contouring tool 33, 41 mounted in tool holder 32 is arranged on frame 2 between undercarriages 3, 3. This arrangement has the advantage that the track is clamped between the undercarriages which transmit the heavy weight of the machine to the track so that the track rails being milled are held in a vise-like action between the undercarriages. Therefore, the milling forces applied to the track rails will cause no lateral displacement of the track. Furthermore, this arrangement favors the formation of a more or less continuous shaving 79 as the irregularities are milled off the rail head during the continuous movement of machine 1 along track 7. The rigid connection between the mounting, the tool head and the tool proper makes it possible to mill not only weld beads at abutting rail joints but to remove metal shavings of an order of gage magnitude of several tenths of millimeters.

The illustrated mounting and guide roller means constitute a single-track carriage movable along a respective rail, the mounting including a substantially central arranged housing 55 displaceably receiving two-part tool head 31. This provides a very simple mounting structure which is readily visible to the operator in either operating direction. The arrangement of connecting rod 14 extending in the direction of the track and linking one end of the mounting to machine frame 2 assures movement of the mounting with the machine in the operating direction indicated by arrow 10. The connecting rod absorbs tensile as well as pressure forces.

As shown and described hereinabove, all movable parts have drives remote controlled by control 17 connected to central power plant 15 on machine frame 2. The illustrated and preferred drives are hydraulically operated. In this manner, the operator may rigidly make all required adjustments by remote control during the operation so that no additional operating personnel is required, for example for observing the operating from the track shoulders.

According to a preferred feature, a safety device comprised of control element 80 is connected to central control 17 by conduit 81 and operates the control in response to set operating parameters of the machine, such as the speed of the continuous movement thereof or the hydraulic fluid pressure in the hydraulic conduit system, whereby drives 13, 59 and 64, 65 are properly timed for raising and lowering the mounting 11, 12 and for displacing tool head 31 parallel and perpendicularly to the track to obtain the desired operative setting of rail contouring tool 33, 41. This imparts great operating safety to the machine during its regular operating cycle and especially during unforeseen disturbances. This safety device will, in particular, prevent the cutting blade from remaining engaged with the rail head when the machine is stopped because of some operating failure, which would in most instances lead to the destruction of the blade.

While a preferred embodiment incorporating various optional, but preferred, features has been described and illustrated, the present invention is not limited thereto. By way of example, the cylindrical guide columns for the tool head could be replaced by other types of guide means, such as guide tracks of rectangular cross section cooperating with like guide means on the tool head. Furthermore, the axes of the guide rollers laterally guiding the mounting along the side of the rail head which is not worn may be inclined instead of being perpendicular to the track and the roller periphery need not be cylindrical. Finally, while all the drives have been shown as hydraulically operated, at least some of them could be operated mechanically, pneumatically or electrically.

Various other modifications and variations may occur to those skilled in the art, particularly after benefitting from the present teaching, without departing from the spirit and scope of this invention as defined by the appended claims.

What is claimed is:

1. A mobile rail contouring machine mounted on a railroad track for continuous movement in an operating direction, the track including two rails each having a rail head defining a gage side, a field side and a running surface, the gage and field sides extending from the running surface to a lower edge of the rail head, the machine being arranged for continuously removing such running surface irregularities as ripples, corrugations and overflow metal during the continuous movement and comprising (a) a frame, (b) a rail contouring tool mounting linked to the frame, (c) guide roller means for vertically and laterally guiding the mounting without play along the rail head of one of the rails, the guide roller means including (1) guide rollers engaging and vertically guiding the mounting along the running surface of the one rail head, and (2) additional guide rollers below said guide rollers for laterally guiding the mounting along a selected one of the sides of the rail head and engaging the selected rail head side in a region extending from the lower edge to below the running surface, (d) drive means linking the mounting to the frame and for vertically adjusting the mounting relative to the running surface of the rail head of the one rail and for pressing the mounting thereagainst, (e) a rail contouring tool head including a tool holder arranged on the mounting, (f) a rail contouring tool mounted in the tool holder, and (g) hydraulic drive means for displacing the tool head with respect to the mounting along guide columns in directions extending substantially parallel to the track and substantially perpendicularly thereto.

2. The mobile rail contouring machine of claim 1, wherein the rail contouring tool is a planning tool for continuously milling the running surface irregularities off the rail head.

3. The mobile rail contouring machine of claim 1 or 2, wherein the tool head is arranged substantially centrally on the mounting and the guide columns comprise a first pair of guide columns extending in one of the directions and affixed to the mounting, and a second pair of guide columns extending in the other direction and affixed to the tool head.

4. The mobile rail contouring machine of claim 3, wherein the guide columns are cylindrical.

5. The mobile rail contouring machine of claim 3, wherein the guide columns of the second pair extend in a direction substantially parallel to the track.

6. The mobile rail contouring machine of claim 5, wherein the first pair of guide columns is arranged between the second pair of guide columns.

7. The mobile rail contouring machine of claim 5, wherein the means for displacing the tool head in a direction substantially parallel to the track comprises a hydraulic cylinder-piston drive, the cylinder of the drive being glidably mounted on one of the guide columns of the second pair and the drive piston being a double-acting piston affixed to the one guide column within the cylinder.

8. The mobile rail contouring machine of claim 1 or 2, further comprising adjustable stop means for limiting the displacement of the tool head in said directions whereby the tool may be set for a predetermined removal depth.

9. The mobile rail contouring machine of claim 8, wherein each one of the adjustable stop means comprises an adjustable stop element, an abutment element for engagement with the stop element, the stop means elements being respectively mounted on the mounting and on the tool head, and an intermediate stop mounted for insertion between the adjustable stop element and the abutment element, the intermediate stop having a thickness corresponding substantially to the depth of removal to be obtained during one pass of the machine during the continuous movement thereof.

10. The mobile rail contouring machine of claim 8, wherein the adjustable stop means for limiting the displacement of the tool head in a direction substantially parallel to the track comprises a first adjustable stop element mounted on the tool head and an abutment element affixed to the mounting for engagement with the first adjustable stop element, and another adjustable stop element mounted on the mounting and another abutment element affixed to the tool head for engagement with the other adjustable stop element.

11. The mobile rail contouring machine of claim 1 or 2, wherein the mounting comprises a yoke and the means for displacing the tool head in a direction substantially perpendicular to the track comprises a drive connecting the tool head to the yoke of the mounting substantially at the center of the yoke.

12. The mobile rail contouring machine of claim 2, wherein a single one of the mountings is linked to the machine frame in association with the one rail, a single one of the tool heads is arranged on the mounting and a single one of the planing tools having a cutting blade is mounted on the tool holder of the tool head.

13. The mobile rail contouring machine of claim 12, wherein the single mounting is associated with each rail, the mountings are in substantial alignment in a direction extending transversely to the rails, and further comprising transversely extending spacing members continuously adjustable to the gage of the track and linking the mountings to each other.

14. The mobile rail contouring machine of claim 13, further comprising a means for centering the linked mountings with respect to the track rails, the centering means including a substantially horizontally extending drive generating a horizontal force component, the drive having one end linked to one of the mountings and another end linked to the machine frame.

15. The mobile rail contouring machine of claim 13, further comprising drive means for continuously pressing the guide roller means for laterally guiding the mounting against the sides of the rail heads.

16. The mobile rail contouring machine of claim 15, wherein the drive means is constituted by hydraulic drives connected to the spacing members.

17. The mobile rail contouring machine of claim 15 or 16, wherein the spacing members are comprised of two substantially parallel telescoping cylinder-piston devices having their respective ends linked to the mountings, a pivot extending vertically to the track linking each end of the cylinder-piston devices to the mountings, and a further pivot extending parallel to the track at diagonally opposite ones of the ends whereby a universal joint is formed between the diagonally opposite ends of the cylinder-piston devices and the mountings.

18. The mobile rail contouring machine of claim 1 or 2, comprising two pairs of said additional guide rollers, the tool head being mounted substantially centrally between the pairs of guide rollers.

19. The mobile rail contouring machine of claim 18, wherein the additional guide rollers of the two pairs have axes extending substantially vertically to the track.

20. The mobile rail contouring machine of claim 1 or 2, comprising two of said guide rollers for vertically guiding the mounting along the running surface of the rail head and two of said additional guide rollers for laterally guiding the mounting along one of the sides of the rail head, the tool head being mounted intermediate the two guide rollers and the two additional guide rollers.

21. The mobile rail contouring machine of claim 1 or 2, wherein the guide roller means comprises two sets of three of said guide rollers for vertically guiding the mounting along the running surface of the rail head, each one of the two sets including a respective one of the guide rollers adjacent the tool head and the tool head being mounted substantially centrally between the respective guide rollers, and two pairs of said additional guide rollers for laterally guiding the mounting along a selected one of the sides of the rail head, the two pairs of the additional guide rollers being immediately adjacent the respective guide rollers.

22. The mobile rail contouring machine of claim 21, wherein the guide rollers of the two sets are detachably arranged on the mounting for selective use thereof.

23. The mobile rail contouring machine of claim 1 or 2, wherein the machine frame is a relatively heavy frame having two undercarriages supporting the frame on the track for continuous movement thereof.

24. The mobile rail contouring the machine of claim 23, wherein the mounting with the tool head and the rail contouring tool mounted in the tool holder is arranged on the frame between the undercarriages.

25. The mobile rail contouring machine of claim 23, wherein the mounting and the guide roller means constitute a single-track carriage movable along the one rail, the mounting including a substantially centrally arranged housing displaceably receiving the tool head.

26. The mobile rail contouring machine of claim 25, further comprising a connecting rod extending in the direction of the track and linking one end of the mounting to the machine frame.

27. The mobile rail contouring machine of claim 1 or 2, further comprising a central power plant and a control mounted on the machine frame for remote control of the drive means and the tool head displacing means.

28. The mobile rail contouring machine of claim 27, further comprising adjustable stop means for limiting the displacement of the tool head in said directions whereby the tool may be set for a predetermined removal depth, the adjustable stop means comprising an adjustable stop element, an abutment element for engagement with the stop element, the stop means elements being respectively mounted on the mounting and on the tool head, and an intermediate stop mounted for insertion between the adjustable stop element and the abutment element, the intermediate stop having a thickness corresponding substantially to the depth of removal to be obtained during one pass of the machine during the continuous movement thereof, the central power plant and the control being arranged for remote control of the stop elements and the intermediate stops.

29. The mobile rail contouring machine of claim 27, wherein a single one of the mountings is linked to the machine frame in association with each rail, further comprising transversely extending spacing members continuously adjustable to the gage of the track and linking the mountings to each other, the central power plant and the control being arranged for remote control of the adjustment of the spacing members.

30. The mobile rail contouring machine of claim 27, further comprising a safety device comprised of a control element connected to the control and arranged to operate the control in response to set operating parameters of the machine whereby the drive means and the tool head displacing means are timed to obtain a desired operative setting of the rail contouring tool.

* * * * *